US010267079B2

(12) United States Patent
Mayr

(10) Patent No.: US 10,267,079 B2
(45) Date of Patent: Apr. 23, 2019

(54) SYSTEM AND METHOD OF BLOCKAGE DETECTION DURING AN AUTOMATIC ADJUSTMENT OF A MOVABLE VEHICLE PART IN A MOTOR VEHICLE

(71) Applicant: Bayerische Motoren Werke Aktiengesellschaft, Munich (DE)

(72) Inventor: Juergen Mayr, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/811,041

(22) Filed: Jul. 28, 2015

(65) Prior Publication Data

US 2015/0330135 A1 Nov. 19, 2015

Related U.S. Application Data

(63) Continuation of application No. PCT/EP2014/051652, filed on Jan. 28, 2014.

(30) Foreign Application Priority Data

Jan. 29, 2013 (DE) ..... 10 2013 201 436

(51) Int. Cl.
*E05F 15/73* (2015.01)
*E05F 15/41* (2015.01)

(52) U.S. Cl.
CPC ..... *E05F 15/73* (2015.01); *E05F 15/41* (2015.01); *E05Y 2400/30* (2013.01); *E05Y 2400/36* (2013.01); *E05Y 2400/40* (2013.01); *E05Y 2400/554* (2013.01); *E05Y 2400/564* (2013.01); *E05Y 2400/57* (2013.01);
(Continued)

(58) Field of Classification Search
None
See application file for complete search history.

(56) References Cited

U.S. PATENT DOCUMENTS 5,448,856 A * 9/1995 Moore ..... E05F 15/611 49/28
9,115,527 B2 * 8/2015 Mori ..... E05F 15/695
(Continued)

FOREIGN PATENT DOCUMENTS

CN 101688418 A 3/2010
CN 102470735 A 5/2012
(Continued)

OTHER PUBLICATIONS

Chinese Office Action issued in counterpart Chinese Application No. 201480006445.9, dated Mar. 4, 2016, with English translation (eight (8) pages).
(Continued)

*Primary Examiner* — David P. Merlino
(74) *Attorney, Agent, or Firm* — Crowell & Moring LLP

(57) ABSTRACT

A system and method are provided for detecting blockages during an automatic adjustment of a movable vehicle part in a motor vehicle equipped with an electric motor drive and an electronic control unit. The drive current as well as the movement speed of the drive are detected by the electronic control unit. When the movement speed increases above the normal level, the control unit suppresses the detection of a blockage event if a drive current increase required for the movement speed increase cannot be ascertained.

6 Claims, 1 Drawing Sheet

(52) U.S. Cl.
CPC ..... *E05Y 2800/114* (2013.01); *E05Y 2800/40* (2013.01); *E05Y 2900/546* (2013.01)

(56) References Cited

U.S. PATENT DOCUMENTS

| | | | | |
|---|---|---|---|---|
| 2003/0038606 | A1* | 2/2003 | Beishline | H02H 7/0851 318/452 |
| 2005/0017667 | A1* | 1/2005 | Yamamoto | H02H 7/0851 318/469 |
| 2006/0137251 | A1* | 6/2006 | Imai | E05F 15/40 49/360 |
| 2009/0115366 | A1* | 5/2009 | Mullet | E05F 15/41 318/466 |
| 2009/0265989 | A1 | 10/2009 | Mueller et al. | |
| 2010/0179733 | A1 | 7/2010 | Egger et al. | |
| 2012/0245800 | A1 | 9/2012 | Koberstaedt et al. | |
| 2012/0290177 | A1 | 11/2012 | Wagenhuber et al. | |
| 2012/0323370 | A1 | 12/2012 | Nishikibe et al. | |
| 2014/0173984 | A1* | 6/2014 | Schlesiger | E05F 15/40 49/28 |
| 2015/0059250 | A1* | 3/2015 | Miu | E05F 15/73 49/349 |

FOREIGN PATENT DOCUMENTS

| | | | | |
|---|---|---|---|---|
| CN | 102712293 | A | | 10/2012 |
| DE | 198 47 080 | A1 | | 4/2000 |
| DE | 10 2006 057 680 | B3 | | 4/2008 |
| DE | 10 2009 000 021 | A1 | | 7/2010 |
| JP | 2006214148 | A | * | 8/2006 |
| WO | WO 2006/045289 | A1 | | 5/2006 |

OTHER PUBLICATIONS

German Search Report dated Nov. 25, 2013 with partial English-language translation (ten (10) pages).
International Search Report (PCT/ISA/210) dated Feb. 27, 2014 with English-language translation (four (4) pages).

* cited by examiner

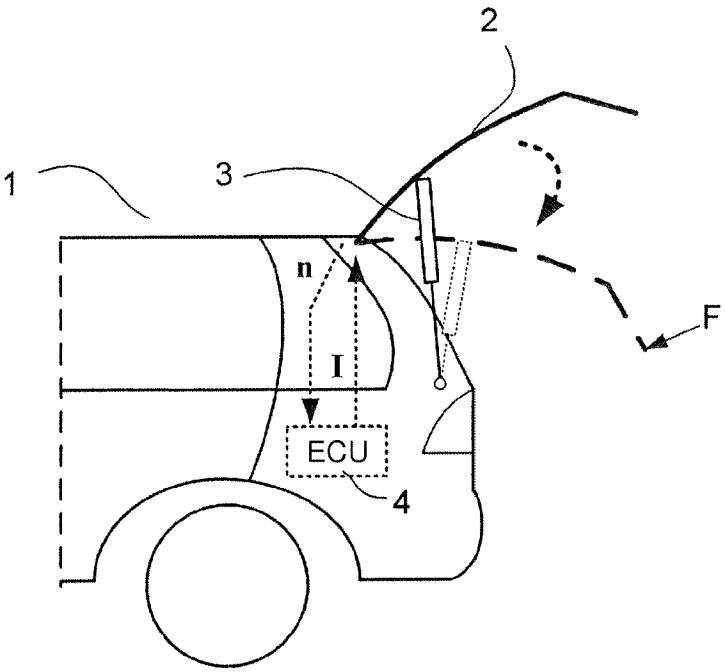
Fig. 1
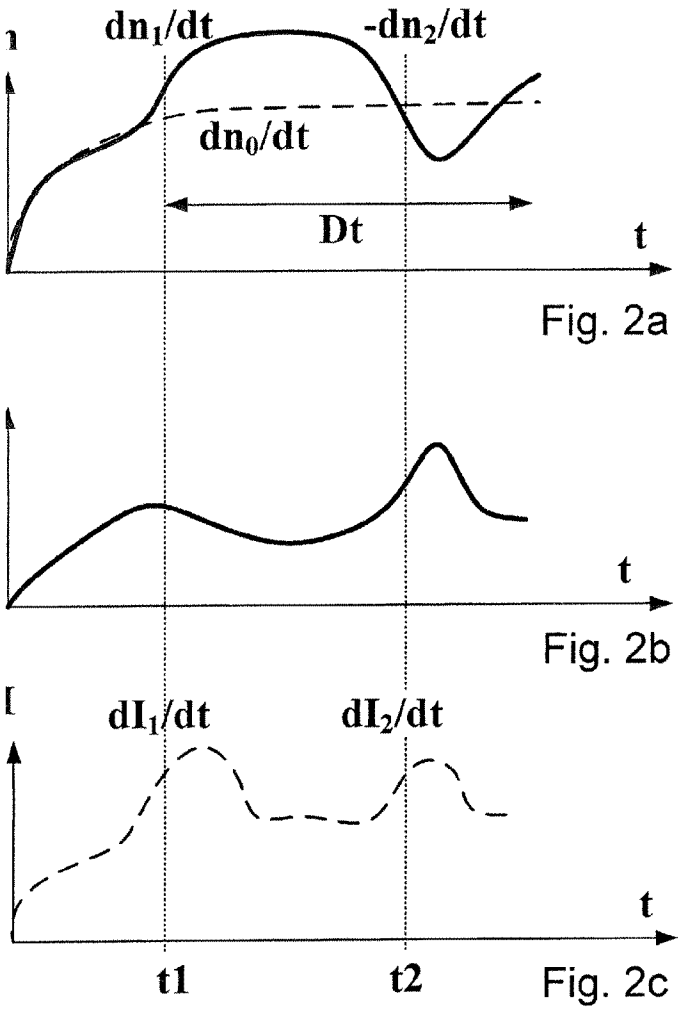

SYSTEM AND METHOD OF BLOCKAGE DETECTION DURING AN AUTOMATIC ADJUSTMENT OF A MOVABLE VEHICLE PART IN A MOTOR VEHICLE

CROSS REFERENCE TO RELATED APPLICATIONS

This application is a continuation of PCT International Application No. PCT/EP2014/051652, filed Jan. 28, 2014, which claims priority under 35 U.S.C. § 119 from German Patent Application No. 10 2013 201 436.8, filed Jan. 29, 2013, the entire disclosures of which are herein expressly incorporated by reference.

BACKGROUND AND SUMMARY OF THE INVENTION

The invention relates to a system and method of blockage detection during an automatic adjustment of a movable vehicle part (window, tailgate, sliding door, side gullwing door, roof window, etc.) in a motor vehicle.

Current vehicles with an automatically opening or closing tailgate—as an example of a movable vehicle part—, on the control side, usually have an automatic control logic for the detection and prevention of a jamming or blocking event. For example, in this case, the rotational speed or the current of an electric motor as the drive for the adjustment is determined and monitored with respect to a sudden change of triggering thresholds. By means of correspondingly low triggering thresholds, a sensible and secure response behavior can be achieved in the event of a blockage and, as a result, the risk of injury in the pivoting range can be reduced to a minimum by stopping the electric motor (drive).

It is an object of the invention that, while the reduced risk of injury is maintained, nevertheless the availability of the automatic operation is to be increased when adjusting a movable vehicle part.

This and other objects are achieved in accordance with embodiments of the invention.

The blockage detection system according to the invention for detecting a blockage during an automatic adjustment of a movable vehicle part in a motor vehicle has an electric motor drive and an electronic control unit. The electronic control unit basically triggers the electric motor drive by way of a drive current such that a certain movement speed is reached. The electronic control unit detects and monitors the drive current as well as the movement speed of the drive. When the movement speed increases above a normal level, the control unit suppresses the detection of a blockage event if a drive current increase required for the movement speed increase cannot be determined. For the implementation of this blockage detection optimized according to the invention, the electronic control unit contains, for example, a correspondingly programmed software module.

The invention is based on the following considerations, recognitions and ideas.

For achieving a response behavior of the jamming or blockage detection that is as sensitive as possible, the triggering thresholds have to be selected to be correspondingly low. In certain cases, particularly in the case of an additional manual operation (such as a lifting by hand during the automatic opening operation), this results in supposedly detected jamming or blockage events. This is caused by the fact that, as a result of the additional manual lifting, for example, of a tailgate, the normally required drive current is reduced or the rotational speed (movement speed) is increased above the value of the purely automatic method. In contrast, a termination of the manual assistance, in turn, leads to a brief current rise or rotational speed drop. As a result of a thereby triggered blockage detection according to the state of the art, the actuators (electric-motor drive) are stopped and the automatic opening or closing operation of a vehicle part is thereby terminated. This may result in misunderstanding and annoyance based on the resulting limited availability of the automatic adjusting systems.

According to the invention, it is therefore provided to mutually link the drive current and motion speed signals (for example, the rotational speed signal) of the drive (for example, the electric motor) in an intelligent manner for plausibility monitoring as follows. By taking into account a rotational speed rising above a normal level, without the increased drive current demand actually required for this purpose, a manual assistance can be inferred in the same direction as the automatic adjusting direction of a vehicle part. The rotational speed drop or current rise occurring at the termination of the manual assistance can then be correspondingly ignored for a certain time window and/or a certain travel of the vehicle part.

Also, after a detected manual assistance for a certain time window and/or a certain travel, a reaction may take place only to a greater change of the movement speed and/or of the drive current, in order to continue to prevent the supposed detection of a blockage event.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 1 is a schematic representation of the components and signals relevant to the invention in the exemplary case where a tailgate is the movable vehicle part; and FIGS. 2*a*, 2*b* and 2*c* are each a schematic representation of the signal forms to essentially be observed for the invention.

DETAILED DESCRIPTION OF THE DRAWINGS

FIG. 1 is a side view illustrating the rear half of a vehicle 1 with an automatically adjustable tailgate 2 and an electric motor drive 3 in the form of an electric motor (here, a spindle motor). The electric motor 3 is triggered by way of a drive current I.

The desired value of the drive current I is automatically controlled by an electronic control unit 4. The actual value of the drive current I is detected and evaluated by the control unit 4. Furthermore, the movement speed of the tailgate 2 is detected and evaluated in the control unit 4 by way of the rotational speed n of the electric motor 3.

The control unit 4 contains a correspondingly programmed software module (not shown here in detail), by which, in the event of an increase $dn_1/dt$ of the rotational speed or movement speed n occurring above the normal level $dn_0/dt$, the detection of a blocking event is suppressed when a rise $dI_1/dt$ of the drive current I required for this increase $dn_1/dt$ of the movement speed n cannot be determined. In the following, an example will be explained in detail by reference to FIGS. 2*a* to 2*c:*

In FIG. 2*a*, the rotational speed n is illustrated over the time t. First, an exclusively automatic closing operation of the tailgate 2 is carried out (broken line in FIG. 1). The rotational speed increases with a normal level being $dn_0/dt$. At the point in time t1, the closing operation is assisted by a manually implemented additional force F on the tailgate 2. As a result, the rotational speed n increases with a gradient $dn_1/dt$ occurring above the normal level $dn_0/dt$. FIG. 2*c* illustrates that, for this increase $dn_1/dt$ of the movement speed n, a rise $dI_1/dt$ of the drive current I would be required (illustrated by a broken line) which, however, could in fact not be determined (solid line) in this embodiment according to FIG. 2*b* at the point in time t1. The drive current I may even slightly drop starting from the point in time t1 as a result of the manual assistance. The detection of a blockage event is therefore correctly suppressed and the tailgate 2 continues to be closed automatically.

When the force F is removed again at the point in time t2 and the manual assistance in the closing direction is therefore terminated, this will result in a rotational speed drop $-dn_2/dt$. In a further aspect of the invention, the detection of the blockage event now continues to be suppressed when, after or during a predefined time period Dt (or a predefined travel), starting with the occurrence of the increase $dn_1/dt$, the drop $-dn_2/dt$ of the rotational speed n is detected with the simultaneous rise $dI_2/dt$ of the drive current I.

Therefore, in principle, no blockage event is detected in the case of a course of the drive current I according to FIG. 2*b*.

In a further preferred development of the invention, after the expiration of a predefined time or of a predefined travel of the movable vehicle part 2, starting with the suppression of the detection of a blockage event, the control unit 4 will continue to permit an increasing of the movement speed n above the already raised increase $dn_1/dt$ without detecting a blockage event, if the drive current I continues to not rise correspondingly.

The invention can naturally be used not only for the closing operation but in the same manner for the opening operation with manual assistance in the opening direction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A system for detecting blockages during an automatic adjustment of a movable vehicle part in a motor vehicle, comprising:

an electric motor drive configured to move the movable vehicle part in the motor vehicle;

an electronic control unit in communication with the electric-motor drive, wherein the electronic control unit detects a drive current and a movement speed of the electric motor drive, and the electronic control unit is configured to first determine whether the detected drive current corresponds to a given drive current that is required to achieve the detected movement speed of the electric motor drive, and the electronic control unit is configured to then determine whether or not a blockage exists based on a result of the first determination, wherein the electronic control unit prevents detection of a blockage when the movement speed increases above a given value but an associated increase of the drive current for the increased movement speed is not detected.

2. The system according to claim 1, wherein the electronic control unit continues to prevent the detection of a blockage during a predefined time period or a predefined travel amount following the movement speed increase above the given value, if a drop of the movement speed is detected with a simultaneous increase of the drive current, wherein a maximum amount of the predefined time period or the predefined travel amount occurs either when the movable vehicle part has reached its fully open or fully closed position.

3. The system according to claim 2, wherein after the expiration of the predefined time period or the predefined travel amount, the electronic control unit continues to permit an increase of the movement speed above the already increased movement speed without detecting the blockage if the drive current continues to not rise correspondingly.

4. A method of operating a blockage detection system during an automatic adjustment of a movable vehicle part in a motor vehicle, the motor vehicle being equipped with an electric-motor drive for the movable vehicle part and an electronic control unit coupled with the electric-motor drive, the method comprising the acts of:

detecting a drive current and a movement speed of the electric motor drive, via the electronic control unit, during the automatic adjustment of the movable vehicle part in the motor vehicle;

first determining whether the detected drive current corresponds to a given drive current that is required to achieve the detected movement speed of the electric motor drive; and then determining whether or not a blockage exists based on a result of the first determination, further comprising the acts of:

detecting, via the electronic control unit, an increase of the movement speed above a given value, which detection normally triggers a detection of a blockage event; and preventing, via the electronic control unit, the detection of the blockage event when the movement speed increases above the given value but a corresponding increase of the drive current for the increased movement speed is not detected.

5. The method according to claim 4, further comprising the act of:

continuing to prevent the detection of the blockage event when, during a predefined time period or predefined travel of the movable vehicle part, a drop of movement speed is detected with a simultaneous increase of the drive current in a case in which the movement speed increased above the given value before the predefined time period or before the predefined travel of the movable vehicle part, and, a maximum amount of the predefined time period or a predefined travel amount occurs either when the movable vehicle part has reached its fully open or fully closed position.

6. The method according to claim 5, further comprising the act of:

after the expiration of the predefined time period or the predefined travel of the movable vehicle part, the electronic control unit continues to permit an increase of the movement speed above the already increased movement speed without detecting a blockage event if the drive current continues to not rise correspondingly.

* * * * *